US006407715B1

(12) United States Patent
Chen

(10) Patent No.: US 6,407,715 B1
(45) Date of Patent: Jun. 18, 2002

(54) DUAL FREQUENCY BAND ANTENNA WITH FOLDED STRUCTURE AND RELATED METHOD

(75) Inventor: Yie-Chang Chen, Yung-Kang (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/848,362

(22) Filed: May 4, 2001

(51) Int. Cl.[7] ..... H01Q 13/10
(52) U.S. Cl. ..... 343/767; 343/770; 343/700 MS
(58) Field of Search ..... 343/702, 767, 343/770, 700 MS

(56) References Cited

U.S. PATENT DOCUMENTS 5,677,698 A * 10/1997 Snowdon ..... 343/702
5,914,693 A * 6/1999 Takei et al. ..... 343/700 MS
5,926,139 A * 7/1999 Korisch ..... 343/700 MS
6,052,093 A * 4/2000 Yao et al. ..... 343/767

* cited by examiner

*Primary Examiner*—Tan Ho
(74) *Attorney, Agent, or Firm*—Winston Hsu

(57) ABSTRACT

An antenna has a conductive ground plate, a conductive first plate set above the ground plate, and a signal feed electrically connected to the ground plate and the first plate. A first distance separates the first plate from the ground plate. The first plate has two slots extending from two edges of the first plate. The two extending points of the two slots are located approximately opposite to each other, and the two slots extend around a central portion of the first plate.

20 Claims, 11 Drawing Sheets

| | unit in mm | unit in inch |
|---|---|---|
| L1 | 25 | 0.99 |
| L2 | 23 | 0.91 |
| L3 | 4 | 0.16 |
| L4 | 6 | 0.24 |
| L6 | 19 | 0.75 |
| L7 | 10 | 0.39 |
| L8 | 32 | 1.26 |
| L9 | 4 | 0.16 |
| L10 | 16 | 0.63 |
| L11 | 17.5 | 0.69 |
| L12 | 32 | 1.26 |
| L13 | 9.5 | 0.37 |
| L14 | 1 | 0.04 |
| L15 | 3 | 0.12 |
| L16 | 26 | 1.02 |
| L17 | 30 | 1.18 |
| L18 | 34 | 1.34 |

Fig. 15

DUAL FREQUENCY BAND ANTENNA WITH FOLDED STRUCTURE AND RELATED METHOD

BACKGROUND OF THE INVENTION

1. Field of the Invention

The present invention relates to an antenna, and more particularly, to an antenna that is operational at dual frequency bands, and having compact size for wireless communication.

2. Description of the Prior Art

Wireless communication, as the term itself implies, needs no cables, fibers or wires to relay signals. This unique feature makes wireless communication an important technology for all communication systems. As the "global village" forms, everyone wants to have convenient access to more information. Portable communication devices based on wireless communication, such as mobile phones, meet that needs.

An antenna used to transmit and receive radio signals is the key element in wireless communication. Antennas must be of high quality and compact according to portable communication device requirements. Moreover, to expand signal transmission capacity, radio signals are modulated with different carrier frequencies, so that the signals can be transmitted via different frequency bands. Also, radio signals with high information density (measured by "transmitted bytes per second" in some systems) widen the bandwidth of the frequency band in modern wireless communication systems. These additional requirements make a modern antenna preferably operative at more than one frequency band with broad bandwidth.

Please refer to FIG. 1. FIG. 1 illustrates a prior art planar antenna 10 disclosed in U.S. Pat. No. 5,926,139. The antenna 10 has two conductive plates 12 and 14, the plate 14 being the ground plate. A signal feeder (not shown) is electrically connected to a contact point 16 on the plate 12, and a pin connector 18 connects the plates 12 and 14. A J-shape slot is cut in the plate 12 to form two parts 17A and 17B connected at the end of the slot. Each of the two parts 17A and 17B corresponds to a frequency band, making the prior art operative in dual frequency bands. However, as the area of the portion connecting parts 17A and 17B at the end of the slot corresponds to the effective bandwidth of the antenna 10, the prior art antenna suffers from narrow bandwidth.

SUMMARY OF THE INVENTION

Therefore, it is an objective of the present invention to provide an antenna that is capable of operating at dual frequency bands with broad bandwidths, yet remains compact in size. Embodiments disclosed in the present invention can be divided into two major forms. The former has a ground plate and a first plate; the latter has a ground plate and a folded structure which is formed by a first plate, a second plate above the first plate, and conductive connectors connecting the first plate and the second plate.

It is a further objective of the present invention to disclose a well-dimensioned embodiment with the folded structure capable of operating at frequency bands specified by GSM (Global System for Mobile communication technical specifications) 900 and GSM 1800.

It is also an objective of the present invention to disclose a method of manufacturing and assembling the embodiment with the folded structure.

In accordance with the claimed invention, the present antenna includes a conductive ground plate, and a conductive first plate and a signal feeder. The first plate is set above the ground plate, with a first distance separating the first plate from the ground plate. The first plate has two slots extending from two edges of the first plate. The two extending points of the two slots are located approximately opposite to each other around a central portion of the first plate. Furthermore, an embodiment with two plates forming a folded structure set above the ground plate is disclosed in the present invention. The folded structure has a first plate and an additional second plate, of the same shape as the first plate. The second plate is set above the first plate and a second distance separates the two plates. Conductive connectors are used to connect the first plate and the second plate.

It is an advantage of the present invention that the antenna is operative at dual frequency bands, with broad bandwidths, without compromising the compactness of size.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

FIG. 15 lists the detailed dimensions indicated by the labels in FIG. 14.

DETAILED DESCRIPTION OF THE PREFERRED EMBODIMENT

Figure 1:
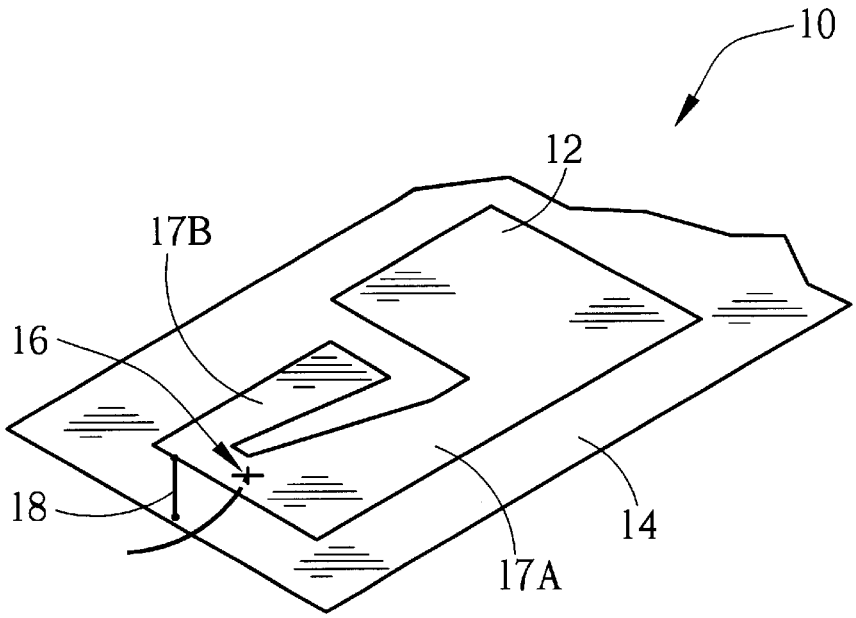
Fig. 1 Prior art
FIG. 1 is a perspective view of the prior art antenna.
Figure 2:
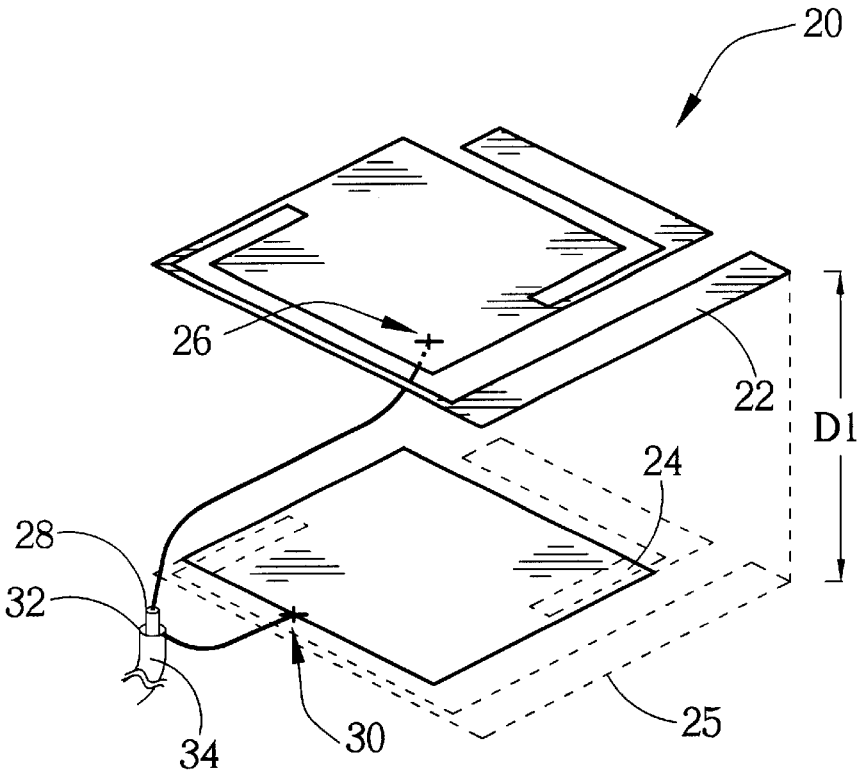
FIG. 2 is a perspective view of a first embodiment of the present invention.

Please refer to FIG. 2. FIG. 2 is a perspective view of a first embodiment of the present invention. An antenna 20 has a conductive first plate 22, a conductive ground plate 24 and a signal feeder 34. The first plate 22 is set above the ground plate 24. A dashed contour 25 shows the projection of the first plate 22 on the ground plate 24. A first distance, measured along the vertical direction and labeled as D1, separates the first plate 22 and the ground plate 24. The signal feeder 34 relays electrical signals to the antenna 20. In the embodiment shown in FIG. 2, the signal feeder 34 has a conductive core 28 isolated from an enclosed cylindrical conductor 32. The core 28 and the cylindrical conductor 32 forms two terminals, respectively. The core 28 (one of the terminals) is electrically connected to the first plate 22 at the point 26, and the cylindrical conductor (the other terminal) 32 is electrically connected to the ground plate 24 at the point 30. Thus, electrical signals can be fed into the antenna 20. Please note that the core 28 of the feeder 34 is connected to the first plate 22 only at the point 26 without conductive contact with any other portion of the first plate 22.

Figure 3:
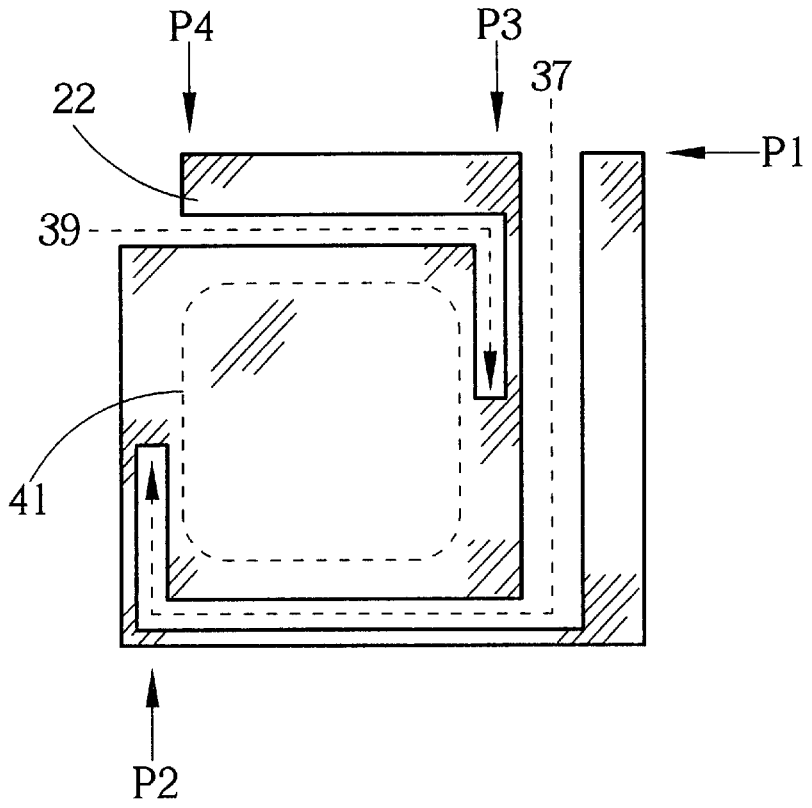
FIG. 3 is a top view of a first plate of the antenna shown in FIG. 2.
Figure 4:
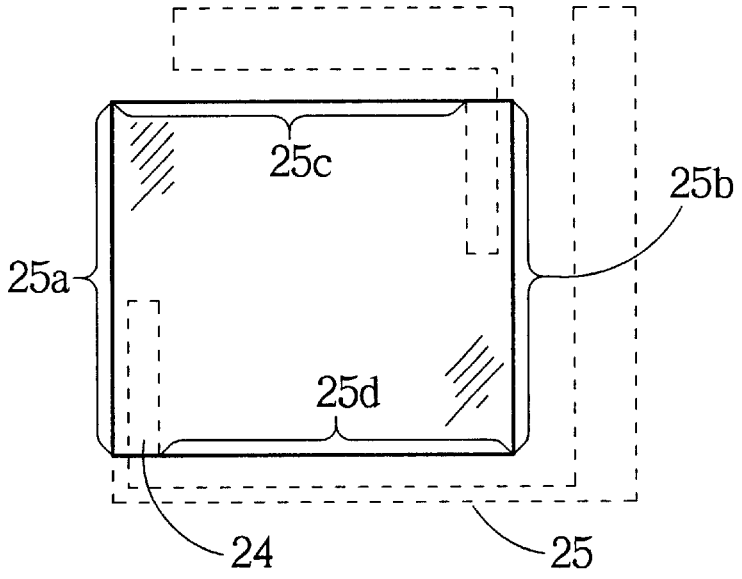
FIG. 4 is a top view of a ground plate of the antenna shown in FIG. 3.

For more detailed inspection of the shapes of the first plate 22 and the ground plate 24, please further refer to FIG. 3 and FIG. 4. FIGS. 3 and 4 are top views of the first plate 22 and the ground plate 24, respectively. As shown in FIG. 3, the first plate 22 has two slots, illustrated by dashed arrow lines 37 and 39 in the figure. The slots 37 and 39 extend from the edges of the first plate 22, and the two extending points are approximately located opposite to each other and the two slots extend around a central portion 41 (denoted by a dashed contour in the figure) of the first plate 22. As an antenna operative in dual frequency bands, each of the slots 37 and 39 has a length that corresponds to a wavelength related to one frequency band in which the antenna 20 is designed to operate. More specifically, the length of the slot 37 between the points P1 and P2 (in FIG. 3) is approximately one quarter of the wavelength corresponding to a first frequency band. The length of the slot 39 between the points P3 and P4 is also approximately one quarter of the wavelength corresponding to another frequency band that the antenna 20 is designed to operate at. As the slots 37 and 39 in FIG. 3 imply, the antenna 20 is designed to operate in two frequency bands characterized by two different wavelengths. Please note that the two slots corresponding to two frequency bands of the antenna 20 are cut in the first plate 22 around a broad central portion 41, so that the antenna 20 can resonate broader bandwidth for each frequency band.

The ground plate 24 shown in FIG. 4 has a rectangular shape. As the ground plate 24 is set below the first plate 22, the dashed contour 25, which indicates the projection of the first plate 22 onto the ground plate 24, reveals the relative positions of the first plate 22 and the ground plate 24. Please note that the edges of the ground plate 24 partially overlap the edges of the first plate 22, as indicated by 25*a*, 25*b*, 25*c* and 25*d* in FIG. 4. For some mobile phones, the electrical circuit shares the same electrical ground with the ground plate of the antenna. Under such circumstances, the ground plate of the antenna 20 can be extended toward the left direction of the drawing (so that the overlapping area of the first plate 22 and the ground plate 24 will be fixed and does not increase as the area of the ground plate increases). However, the edges of the ground plate should be confined by the edges of the first plate 22 at the edges 25*b*, 25*c* and 25*d* (in FIG. 4), so that the radiation function of the slots is not degraded.

As the area of the central portion of the first plate has a positive relation with the bandwidth of the antenna (i. e., the larger the area is, the broader the bandwidths resonate), an embodiment of the present invention with a folded structure is further suggested.

Figure 5:
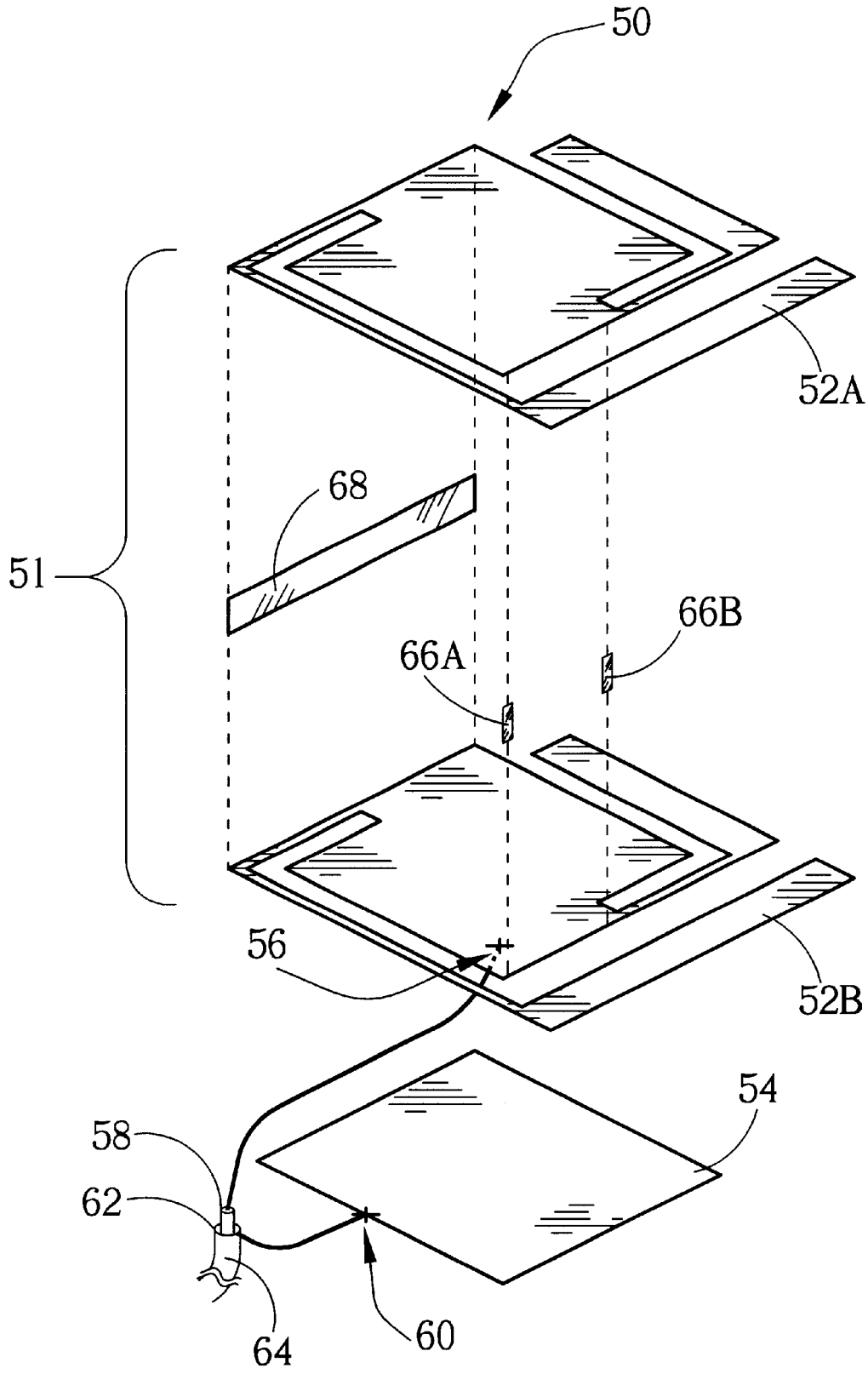
FIG. 5 is an exploded view of a second embodiment of the present invention.
Figure 6:
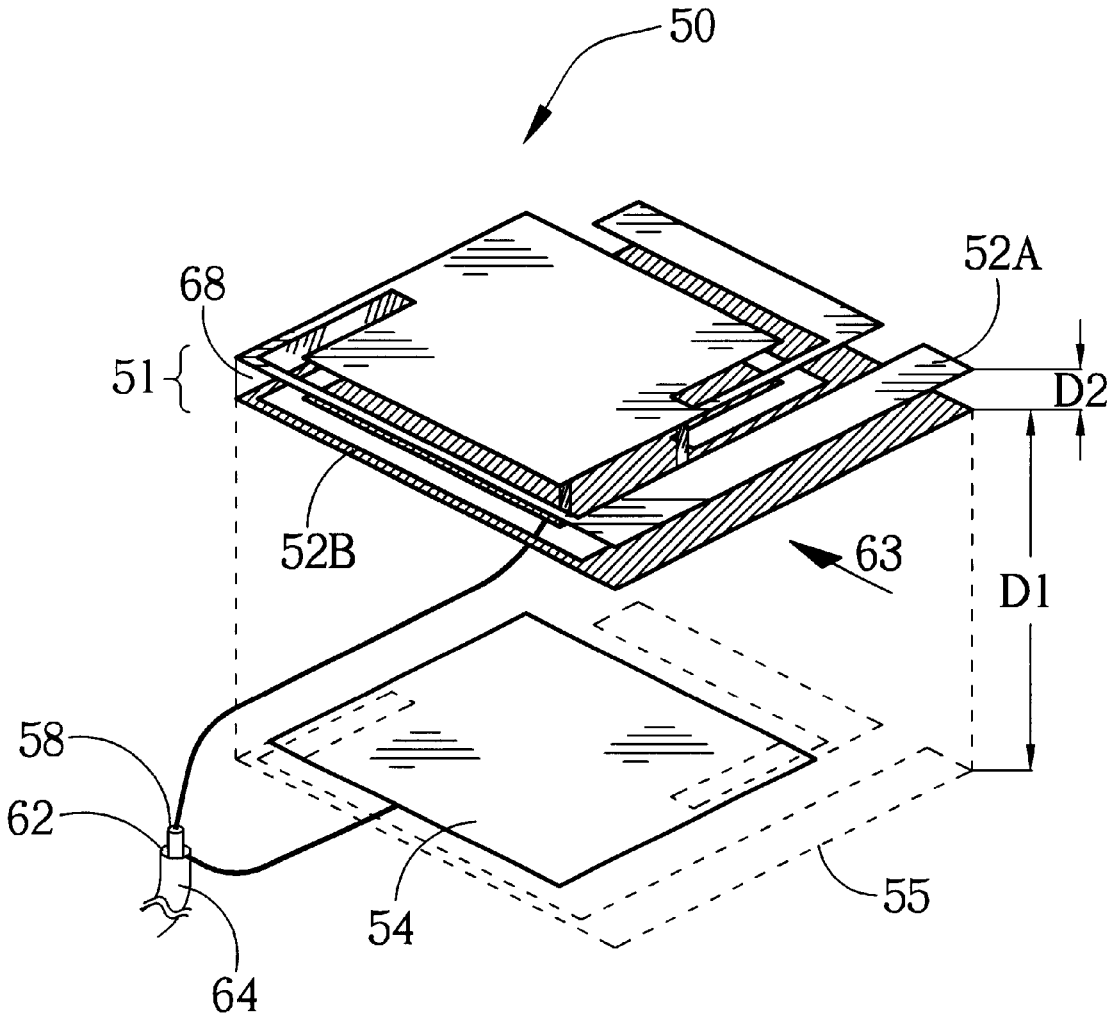
FIG. 6 is a perspective view of an antenna shown in FIG. 5.
Figure 7:
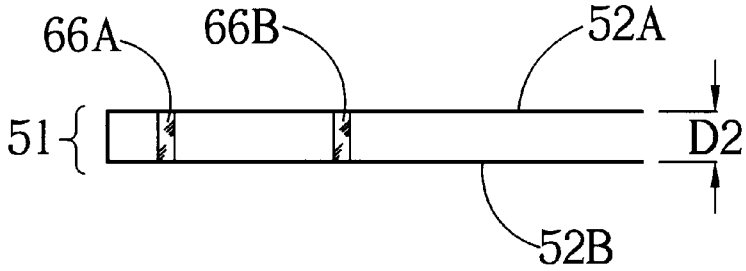
FIG. 7 is a side view of the folded structure of the antenna shown in FIG. 5.

Please refer to FIGS. 5 and 6. FIGS. 5 and 6 are, respectively, the exploded and perspective views of a second antenna 50 according to the present invention. The antenna 50 has a folded structure 51, a conductive ground plate 54, and a signal feeder 62. The folded structure 51 includes a conductive first plate 52B (filled with hatching in FIG. 6), a conductive second plate 52A set above the first plate 52B, and conductive connectors 66A, 66B and 68. The vertical dashed lines in FIG. 5 indicate the horizontal alignment of the first plate 52B, the second plate 52A, and the connectors 66A, 66B and 68. As these vertical dashed lines show, the connectors 66A, 66B and 68 connect the first plate and the second plate at projective portions respectively on the first plate and the second plate. The planar connector 68 is set between the edges of the first plate 52B and the second plate 52A, respectively, near the central portions of the first plate 52B and the second plate 52A. The two planar connectors 66A and 66B are set between the edges of slots on the first plate 52B and the second plate 52A, respectively, near the central portions of the first plate 52B and the second plate 52A. The connectors 66A, 66B and 68, with their upper edges connected to the second plate 52A and their lower edges connected to the first plate 52B, have the same height. Therefore, the first plate 52B and the second plate 52A are kept uniformly separated by a vertically measured second distance D2, as labeled in FIG. 6. The second distance D2 is also indicated in FIG. 7, which illustrates a side view (along the direction 63 in FIG. 6) of the folded structure 51 (the connector 68 is not shown in FIG. 7 to give a better view of positions of the connectors 66A and 66B). For the preferred embodiment, the ratio of the first distance D1 to the second distance D2 is 5 to 3.

Please refer back to FIG. 6. As indicated in FIG. 6, a first distance D1 separates the first plate 52B and the ground plate 54 of the folded structure 51. Similar to the first embodiment of the present invention, the antenna 50 has a signal feeder 64 with a conductive core 58 and a conductive cylinder 62 electrically connected to the position 56 on the first plate 52B and the position 60 on the ground plate 54, respectively (please refer the FIG. 5 for positions 56 and 60). Please note that the core 58 of the feeder 64 is connected to the first plate 52B only at the point 56 without conductive contact with any other portion of the first plate 52B.

Figure 8:
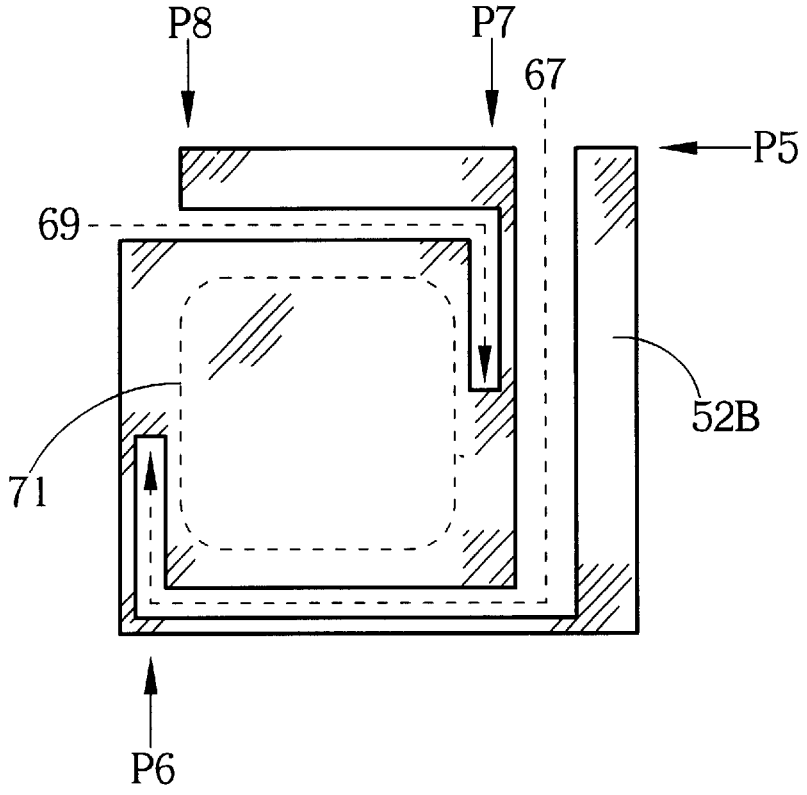
FIG. 8 is a top view of a first plate of the antenna shown in FIG. 5.

The second plate 52A has a shape effectively the same as that of the first plate 52B. The top view of the first plate 52B (and the second plate 52A) is shown in FIG. 8. Two slots, indicated by dashed lines 67 and 69, extend from the edges of the first plate and the two extending points are approximately located opposite to each other and the two slots extend around a central portion 71 of the first plate 52B. Each of the slots 67 and 69 corresponds to a frequency band in which the antenna 50 can operate. More specifically speaking, the length of the slot 69 between the points P7 and P8 is approximately one quarter of the wavelength corresponding to one frequency band. The length of the slot 67 between the points P5 and P6 is approximately one quarter of the wavelength corresponding to another frequency band.

Figure 9:
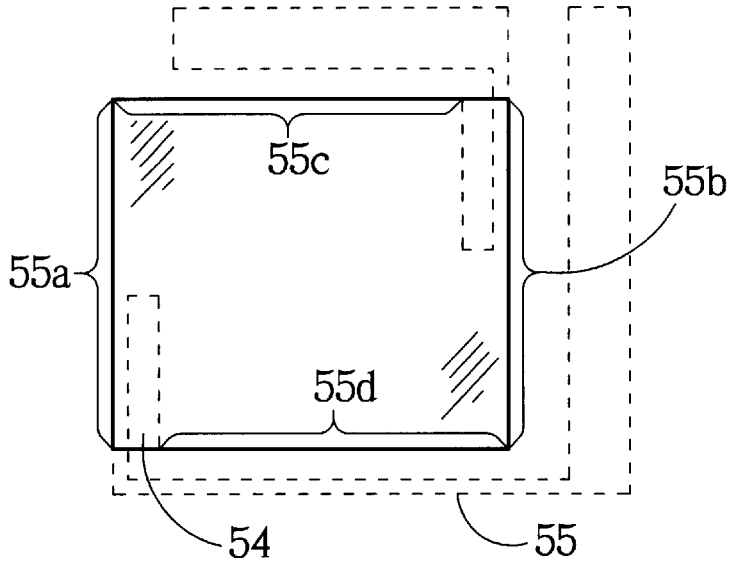
FIG. 9 is a top view of a ground plate of the antenna shown in FIG. 5.

Please refer to FIG. 9. FIG. 9 is a top view of the rectangular ground plate 54 with the dashed contour 55 indicating the projection of the first plate 52B onto the ground plate 54. The edges of the ground plate 54 overlap with the edges of the projective position of the first plate at edges 55*a*, 55*b*, 55*c* and 55*d*. Similar to the first embodiment of the present invention, the ground plate 54 can extend toward the left side (with respect to the drawing) if necessary. However, the other three edges should be confined by the edges 55*b*, 55*c* and 55*d* of the dashed contour 55 so that the slots 67 and 69 can radiate normally.

Figure 10:
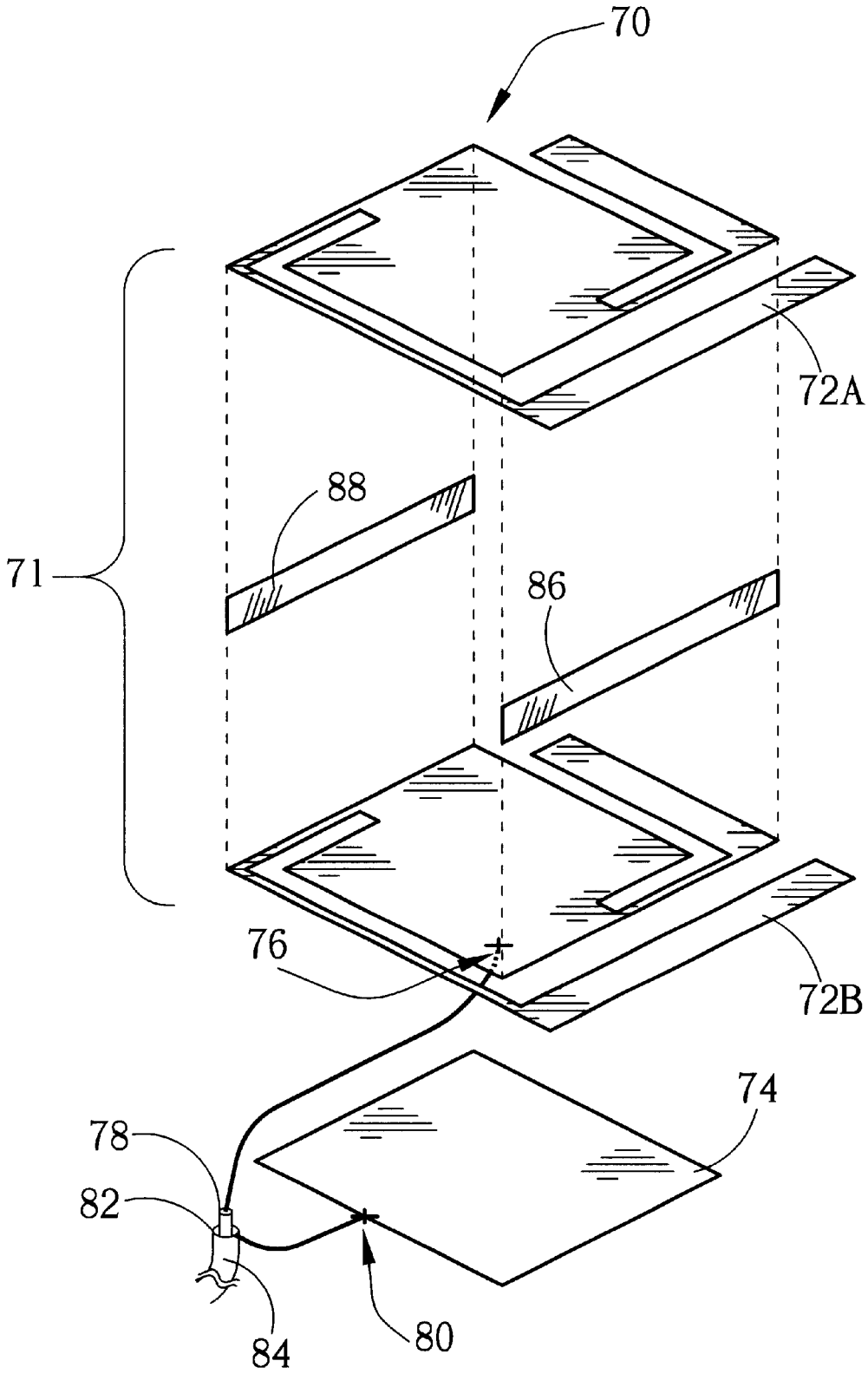
FIG. 10 is an exploded view of a third embodiment of the present invention.

Please refer to FIG. 10. FIG. 10 is an exploded view of a third antenna 70 of the present invention. A first plate 72B, a second plate 72A, a ground plate 74 and a signal feeder 84 fit the description and functionality for corresponding components of the antenna 50. Instead of the two mutually separated connectors 66A and 66B of the antenna 50, a single planar connector 86 is adopted in the antenna 70. Together with the connectors 86 and 88, the first plate 72B and the second plate 72A form a folded structure 71 of the antenna 70.

Figure 11:
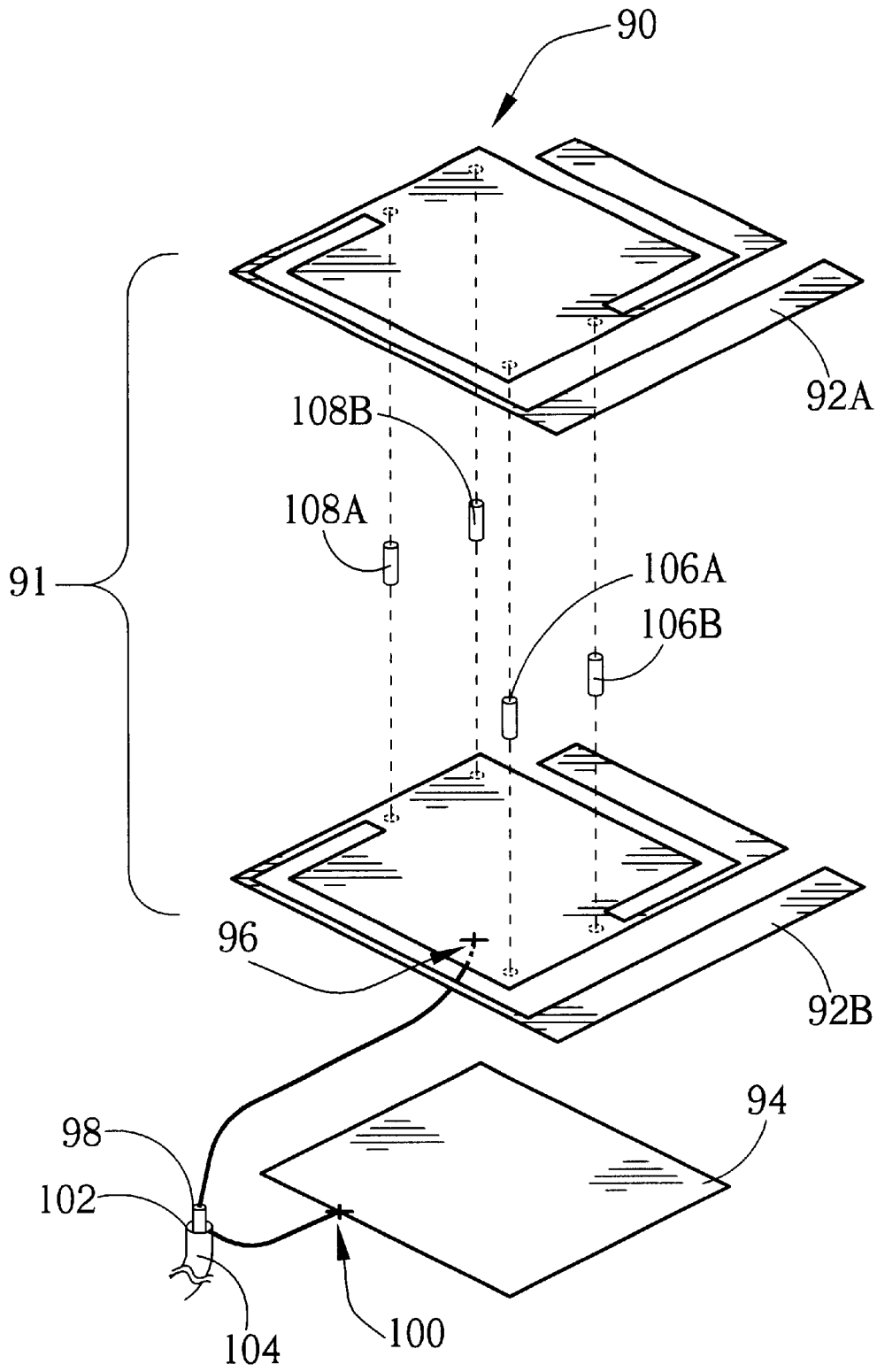
FIG. 11 is an exploded view of a fourth embodiment of the present invention.

Please refer to FIG. 11. FIG. 11 is an exploded view of a fourth antenna 90 of the present invention. Similarly, a first plate 92B, a second plate 92A, a ground plate 94 and a signal feeder 104 fit the description and functionality for corresponding components of the antenna 50. Instead of planar conductive connectors used in the former two embodiments, four conductive pins 106A, 106B, 108A, and 108B are used to connect the first plate 92B and the second plate 92A of the antenna 90. Together with these pins, the first plate 92B and the second plate 92A form a folded structure 91 of the antenna 90.

Figure 12:
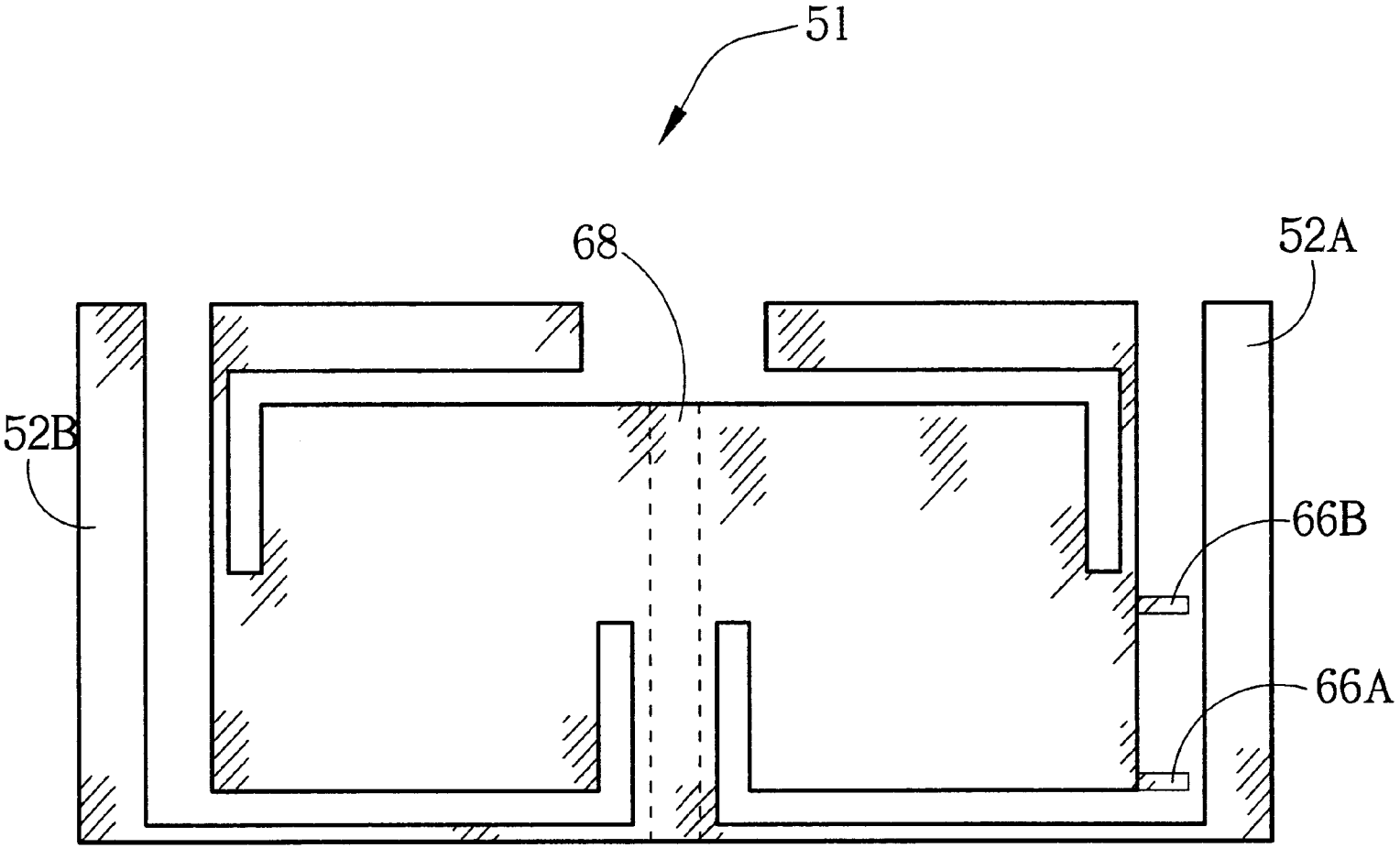
FIG. 12 illustrates how a folded structure in FIG. 5 is flatted on one monolithic plate.
Figure 13:
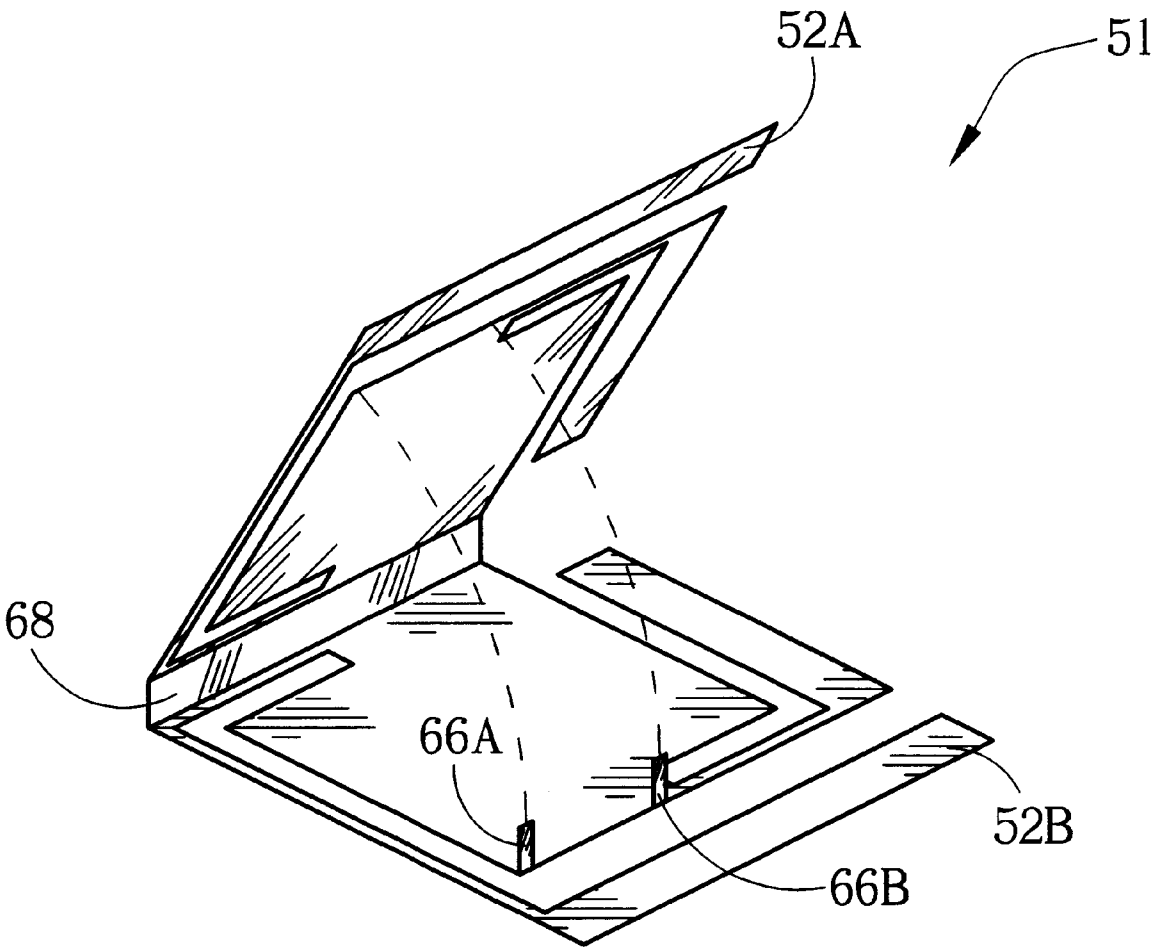
FIG. 13 illustrates how the folded structured forms with the monolithic plate shown in FIG. 12.

The folded structure of the antenna of the present invention is easily manufactured. Please refer to FIGS. 12 and 13. FIG. 12 illustrates how the folded structure 51 (appearing in FIGS. 5, 6 and 7) of the antenna 50 is "flattened" into a single monolithic plate, so that the folded structure can be easily manufactured. FIG. 13 illustrates how the folded structure 51 is formed by "folding" the single plate from FIG. 12. The connectors 66A, 66B and 68 are bent to an upright position. Then, the second plate 52A is folded at the connector 68. The connectors 66A and 66B can then be attached to the second plate 52A by way of soldering.

In addition to air in the above embodiments, other dielectric materials can also be used to fill the space separating the first plate and the ground plate, as well as the space separating the first plate and the second plate of the antennas of the present invention. Also, external dielectric (such as plastic) frames can be used to hold the edges of the first plate, the second plate and/or the ground plate, so as to secure the first distance and/or the second distance of the antenna of the present invention.

Figure 14:
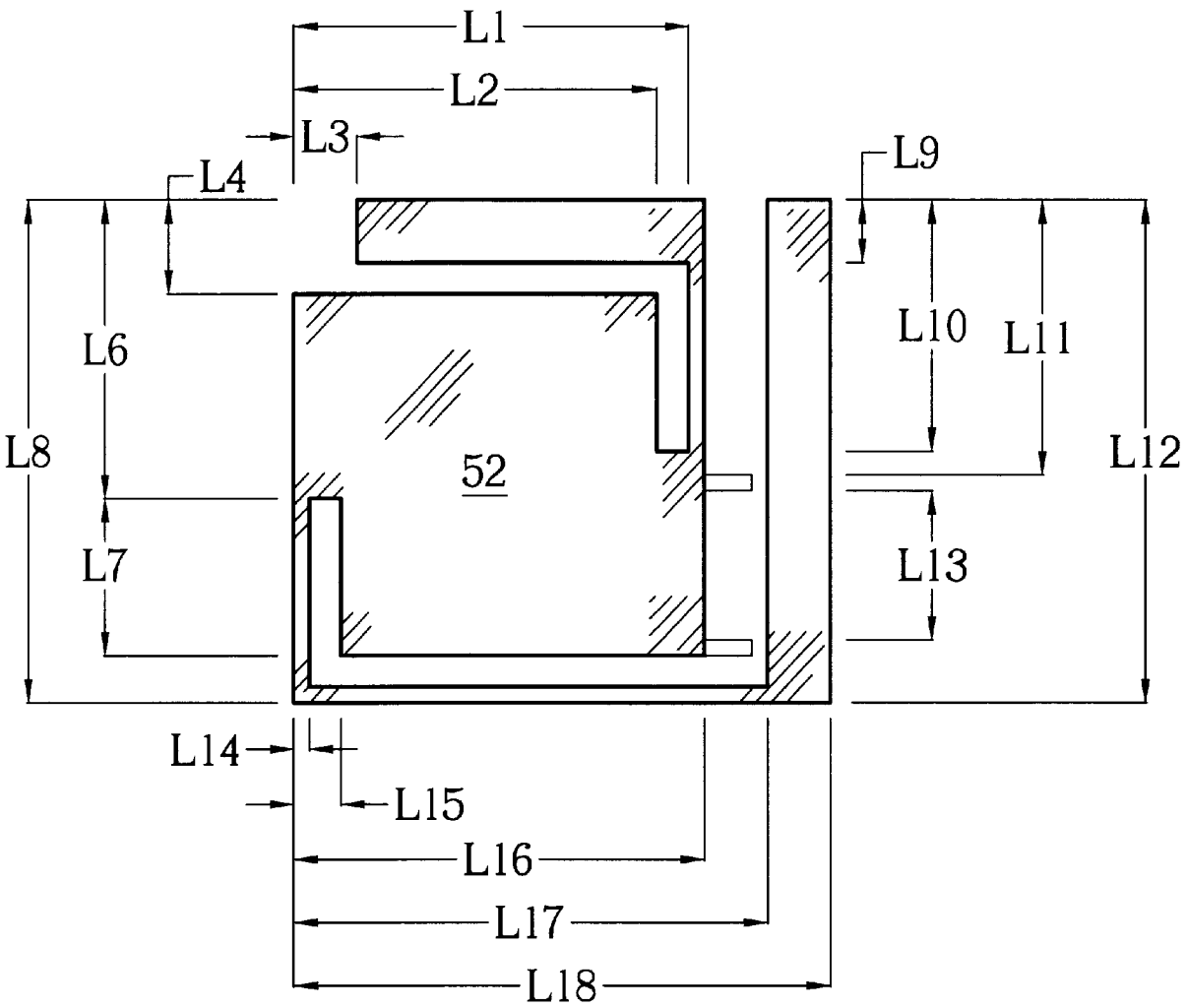
FIG. 14 gives labels for detailed dimensions of the first plate in FIG. 5.

Finally, the detailed dimensions of one embodiment antenna 50 are given for both GSM 900 and 1800 frequency bands with broad bandwidths. Please refer to FIGS. 14 and 15. FIG. 14 labels the dimensions to be measured for the first plate of the antenna 50. FIG. 15 lists the detailed dimensions corresponding to the labels in FIG. 14 in both metric (mm) and English (inch) units. The first distance D1 and the second distance D2 (indicated in FIG. 6) are preferably 5 mm (0.20 inches) and 3 mm (0.12 inches) in this embodiment.

In contrast with the prior art antenna, which uses a single slot to make a dual frequency band antenna, the antennas of the present invention have two slots that extend around a broad central portion of a conductive plate. Antennas of the present invention are not only operative in dual frequency bands. The dimensions of the antenna can be kept compact, as well can bandwidths be kept broad at each operational frequency band. Furthermore, a folded structure disclosed in the present invention antenna can even shrink antenna dimensions without sacrificing bandwidths. According to the performance of a practical embodiment, the antenna of the present invention with the detailed dimensions disclosed in FIGS. 14 and 15 can be operative in both GSM 900 and 1800 frequency bands. The operational bandwidths of the antenna are broad enough to effectively cover the frequency band of GSM 1900.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An antenna comprising:

a conductive ground plate;

a conductive first plate set above the ground plate, a first distance separating the first plate from the ground plate; the first plate having two slots which extend from the edges of the first plate and which end at two positions that are approximately opposite around a central portion of the first plate; and a signal feed having two terminals, the terminals being electrically connected to the ground plate and the first plate, respectively.

2. The antenna of claim 1, wherein the two slots are of different lengths.

3. The antenna of claim 1, wherein each of the two slots has a length that approximately corresponds to one-fourth of a wavelength of a respective frequency in a frequency band in which the antenna is designed to operate.

4. The antenna of claim 1, further comprising a conductive second plate set above the first plate, a second distance separating the second plate from the first plate, and at least one conductive connector connected to both the first plate and the second plate; wherein the second plate has a shape that is effectively the same as the first plate.

5. The antenna of claim 4, wherein the connector is a conductive pin.

6. The antenna of claim 4, wherein the connector connects to a first contact portion and a second contact portion, respectively, on the first plate and the second plate; wherein the first contact portion is at a projective position with the second contact position.

7. The antenna of claim 4, wherein the connector is set between the edges of slots on the first and second plates, respectively, near the central portions of the first plate and the second plate.

8. The antenna of claim 4, wherein the connector is set between the edges of the first and second plates, respectively, near the central portions of the first plate and the second plate.

9. The antenna of claim 4, wherein the ratio of the first distance to the second distance is 5 to 3.

10. The antenna of claim 4, wherein the first plate, the second plate and the connector are formed in a monolithic manner, with the second plate folded around the connector to form the antenna.

11. The antenna of claim 10, further comprising at least one bonding connector also formed with the first plate or the second plate in a monolithic manner, wherein the bonding connector is folded back to connect with the other plate by way of soldering.

12. An antenna comprising:

a conductive ground plate;

a conductive first plate set above the ground plate and separated from the first plate by a first distance, the first plate having a center portion, a first slot extending from a first extending point and a second slot extending from a second extending point, the first extending point and the second extending point being located on the edges of the center portion and being approximately opposite to each other around the central portion; and a signal feed having two terminals, the terminals being electrically connected to the ground plate and the first plate, respectively.

13. The antenna of claim 12, wherein each of the two slots has a length that approximately corresponds to one-fourth of a wavelength of a respective frequency in a frequency band in which the antenna is designed to operate.

14. The antenna of claim 12, further comprising a conductive second plate set above the first plate, the second plate separated from the first plate by a second distance, and at least one conductive connector connected to both the first plate and the second plate; wherein the second plate has a shape that is substantially the same as the first plate.

15. The antenna of claim 14, wherein the connector connects to a first contact portion and a second contact portion, respectively, on the first plate and the second plate; wherein the first contact portion is at a projective position with the second contact position.

16. The antenna of claim 14, wherein the connector is set between the edges of slots on the first and second plates, respectively, near the central portions of the first plate and the second plate.

17. The antenna of claim 14, wherein the connector is set between the edges of the first and second plates, respectively, near the central portions of the first plate and the second plate.

18. The antenna of claim 14, wherein the ratio of the first distance to the second distance is 5 to 3.

19. The antenna of claim 14, wherein the first plate, the second plate and the connector are formed in a monolithic manner, with the second plate folded around the connector to form the antenna.

20. The antenna of claim 19, further comprising at least one bonding connector also formed with the first plate or the second plate in a monolithic manner, wherein the bonding connector is folded back to connect with the other plate by way of soldering.

* * * * *